US005735443A

United States Patent [19]

Ring

[11] Patent Number: 5,735,443

[45] Date of Patent: Apr. 7, 1998

[54] SINGLE PART BURSTER

[76] Inventor: Robert S. Ring, 33 Forest Park Dr., Rochester, N.H. 03868

[21] Appl. No.: 117,669

[22] Filed: Sep. 8, 1993

[51] Int. Cl.[6] ..... B65H 35/10

[52] U.S. Cl. ..... 225/4; 225/100

[58] Field of Search ..... 225/4, 100, 101, 225/106

[56] References Cited

U.S. PATENT DOCUMENTS

| | | | |
|---|---|---|---|
| Re. 30,398 | 9/1980 | Schueler | 225/100 |
| 2,513,093 | 6/1950 | Hageman | 225/100 |
| 3,135,446 | 6/1964 | Sargent | 225/100 |
| 3,161,335 | 12/1964 | Pine et al. | 225/100 |
| 3,191,832 | 6/1965 | Davies | 225/100 |
| 3,425,607 | 2/1969 | Sargent | 225/100 |
| 3,741,451 | 6/1973 | Parenti et al. | 225/4 |
| 3,942,694 | 3/1976 | Jones et al. | 225/100 |
| 4,269,341 | 5/1981 | Polko | 225/94 |
| 4,479,597 | 10/1984 | Johnson et al. | 225/100 |
| 4,529,114 | 7/1985 | Casper et al. | 225/100 |
| 4,577,789 | 3/1986 | Hofmann et al. | 225/100 |
| 4,623,081 | 11/1986 | Hain et al. | 225/105 |
| 5,060,838 | 10/1991 | Gergely, Jr. et al. | 225/100 |
| 5,104,022 | 4/1992 | Nakamura et al. | 225/100 |

FOREIGN PATENT DOCUMENTS

| | | | |
|---|---|---|---|
| 266903 | 5/1988 | European Pat. Off. | 225/100 |

*Primary Examiner*—Eugenia Jones

[57] ABSTRACT

A burster for continuous single part business forms having a paper weight of about 32 lbs. or less utilizes a conventional transport mechanism, high speed rolls, and breaker blade. The slow speed rolls are substantially smooth surfaced (no axial grooves) and are mounted so that there is a fixed gap between them of 0.005–0.008 inches, which gap can be adjusted prior to machine operation. With this fixed gap, bubble formation in the business forms being burst does not occur, and there is no reason to use a servo or stepper motor to cycle the slow speed rolls apart and together. The high speed rolls are spring biased together and the transport mechanism includes a tractor pin feed drive located upstream of the slow speed rolls, a set of driven pull rolls between the tractor pin feed drive and the slow rolls, and a transport belt assembly. Spaced sheet metal plates may be used in place of the slow speed rolls.

14 Claims, 2 Drawing Sheets

FIG. 2
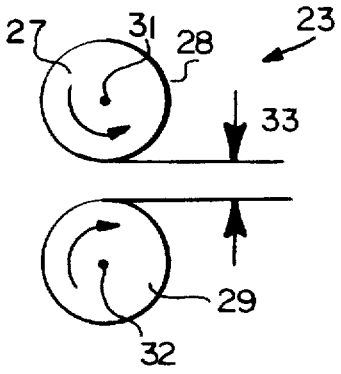
FIG. 3
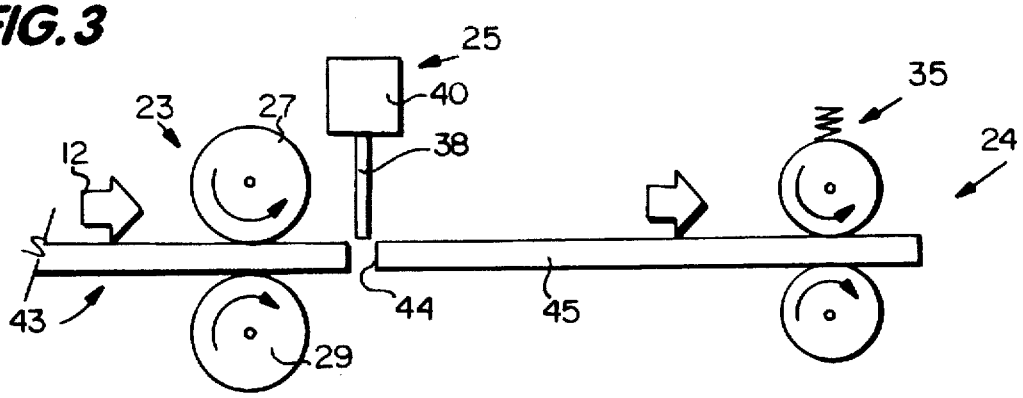
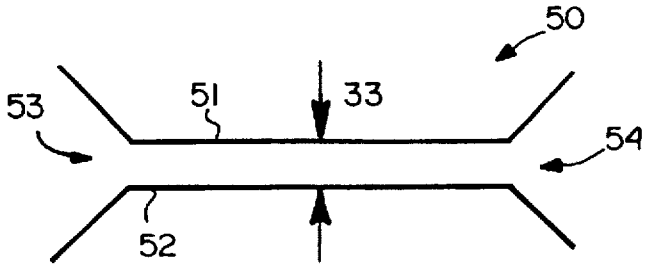
FIG. 4

SINGLE PART BURSTER

BACKGROUND AND SUMMARY OF THE INVENTION

Conventional business form bursters, such as the Moore Models 3500 and 3400(available from Moore Business Forms, Inc. of Lake Forest, Ill.), and such as shown in U.S. Pat. No. 5,104,022 (the disclosure of which is hereby incorporated by reference herein), and co-pending application Ser. No. 08/123971, filed Sep. 21, 1993 require special mechanisms to ensure that they compensate for a form "bubble" that forms ahead of the slow speed rolls of the burster, and require a servo or stepper motor to cycle the slow roll pair apart in the case of the Model 3500. Normally bubble compensation is provided by forming axial grooves in the upper slow roll (which are expensive and difficult to machine) to release the paper two to four times per revolution of the roller in the case of the Model 3400.

According to the present invention, a burster, and a method of bursting business forms using the burster, are provided which eliminate the special mechanisms in conventional bursters described above, yet still achieve the desirable results which ensue from those mechanisms. According to the present invention, a burster is provided in which form bubbles are not created, thereby eliminating the need for axial grooves in the upper slow speed roller, and eliminating the need for a servo or stepper motor to cycle the rolls apart.

Basically, the desired results according to the present invention are achieved by mounting the slow speed rolls of the burster so that they are fixed a predetermined distance apart, which precludes bubble formation. This is typically accomplished by providing the rolls spaced apart between 0.005–0.008 inches, optimally about 0.007 inches. Alternatively, sheet metal guides could be used instead of slow speed rollers. Slow speed rollers are suited to high speed, heavy duty machines. Utilizing the burster of the present invention it is possible to burst forms from up to 32 lbs. stock (32 lbs. per ream of 1000 8½"×11" sheets) at speeds up to 600 feet per minute.

According to one aspect of the present invention a burster for business forms is provided which comprises the following elements: A transport mechanism; a pair of driven high speed rolls; means for guiding forms to said high speed rolls (e.g. slow speed rolls, or a fixed set of sheet metal guides); a breaker blade between the high speed rolls and guiding means; and, means for mounting the guiding means (e.g. slow speed rolls) so that they define a fixed gap, greater than zero, during processing of business forms having a particular weight, sufficient to prevent formation of a form bubble in business forms being burst by the burster. The fixed gap is between 0.005–0.008 inches (typically about 0.007inches). Prior to start up, this gap may be adjusted to accommodate a particular form depth.

The high speed rolls preferably are spring biased together. The transport mechanism preferably comprises a tractor pin feed drive (e.g. with approximately 12–15 pins per form length) located upstream of the slow speed rolls, and a set of driven pull rolls located between the tractor pin feed drive and the slow rolls. A transport belt mechanism also is preferably provided. Where the guiding means comprise slow speed rolls, they are substantially smooth surfaced (that is do not have axial grooves, but may have radial grooves to allow for form guiding fingers). Alternatively, the rolls may comprise knurled steel surfaces or rubber surfaces.

The invention also comprises a method of bursting continuous single part business forms having cross perforation lines formed periodically therein, and having a paper weight of about 32 lbs. or less (typically about 16–32lbs.), utilizing a burster having gapped slow speed rolls upstream of high speed rolls, and a breaker blade between the slow and high speed rolls. The method comprises the steps of: (a) Feeding the forms to the slow speed rolls at a speed not less than a first speed. (b) Driving the slow speed rolls at substantially the first speed. (c) Passing the forms through a gap between the slow speed rolls that is of sufficient spacing to prevent bubble formation in the forms. (d) Driving the high speed rolls at a second speed, substantially greater than the first speed. And, (e) when a perforation moves past the slow speed rolls, effecting bursting at a form cross perforation line. There may also be the step (f) of driving form feeding belts at a third speed slightly higher than the first speed.

Steps (a) through (e) are typically practiced at a speed of up to about 600 fpm, and step (c) is practiced by passing the forms through a fixed gap (which may be adjusted prior to initiation of the process) between the slow speed rolls of between 0.005–0.008 inches (e.g. about 0.007 inches). Step (e) may be practiced by maintaining the breaker blade stationary, and by snapping the forms, at a perforation line thereof, into contact with the stationary breaker blade. Also, fixed sheet metal guide plates may be substituted for the slow speed rolls in non-high speed, non-heavy duty environments.

It is the primary object of the present invention to provide for the simple and effective bursting of single part business forms. This and other objects of the invention will become clear from an inspection of the detailed description of the invention, and from the appended claims.

BRIEF DESCRIPTION OF THE DRAWINGS

FIG. 2 is a detailed schematic view of the slow speed rolls of the burster of FIG. 1 with the gap between them shown greatly exaggerated for clarity of illustration;

FIG. 3 is a diagrammatic side detail view of just the slow and high speed rolls and breaker blade of the burster of FIG. 1 showing a single part form being burst thereby; and FIG. 4 is a view like that of FIG. 2 only showing sheet metal guides instead of slow speed rollers.

DETAILED DESCRIPTION OF THE DRAWINGS

Figure 1:
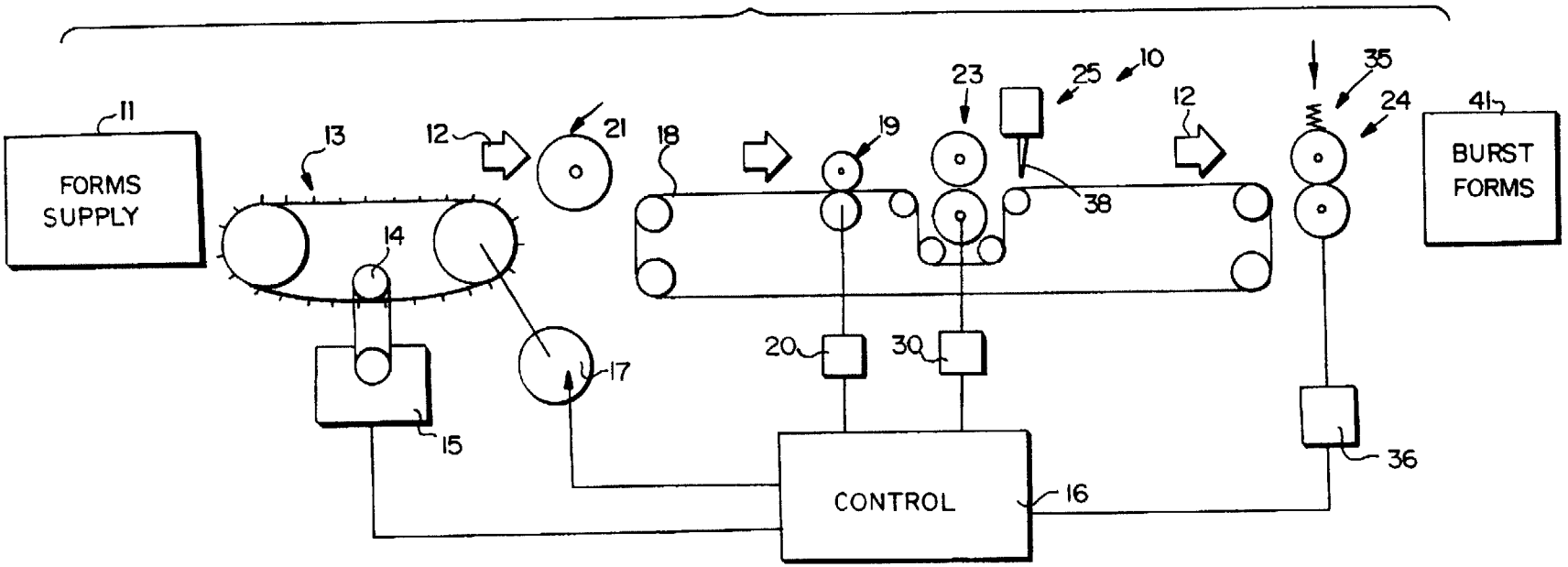
FIG. 1 is a side schematic view of exemplary apparatus according to the present invention.

An exemplary burster according to the present invention is shown generally by reference numeral 10 in FIG. 1. Single part business forms, in continuous format with a form weight of about 32 lbs. or less (e.g. about 16–32 lbs.) from a source of supply 11 (such as a printer) are fed in the direction of arrow 12 utilizing a transport mechanism. The transport mechanism may comprise a number of different parts, and may include the tractor pin feed drive 13 which has about 12–15 pins per form length which is driven by a gear 14 and a motor 15, under the control of controller (e.g. computer) 16. A paper drive encoder 17, operatively connected to the controller 16, also is preferably provided, as is conventional. The transport mechanism also further comprises a continuous transport belt assembly 18, and a set of driven pull rolls 19, powered by a motor 20 also operatively connected to the controller 16. The belt assembly 18 may be operated at a speed slightly higher than the slow speed rollers (23, described below), but less than the speed of high speed rollers (24, described below). A conventional slitter mechanism 21 is also typically provided to slit off the tractor drive strips along the sides of the continuous business forms after they are initially driven by the tractor pin feed drive 13.

In order to perform the bursting action, the burster 10 includes a pair of slow speed rolls 23, a pair of high speed rolls 24 downstream of the slow speed rolls 23, and a breaker blade assembly 25 between the rolls 23, 24 (typically immediately past the rolls 23). The slow speed rolls 23, as seen in all of FIGS. 1 through 3, preferably comprise an upper roll 27, which is substantively smooth surfaced—see 28 (i.e. has no axial grooves therein necessary to compensate for form bubble formation, but may have radial grooves, and which may be knurled or rubber coated) and a smooth exterior surface bottom roll 29 (which also maybe knurled or rubber coated), which is driven by the motor 30, also under the control of the controller 16. The term "substantially smooth surfaced" as used in the present application includes smooth, knurled, rubber coated, or radially grooved rolls, but not axially grooved rolls.

The rolls 27, 29 are driven in the direction of the arrows illustrated in FIG. 2 at substantially the same speed as (or slightly less than) the forms are driven in direction 12 by the transport mechanism (13, 18, 19), e.g. at up to about 600 fpm. While a plurality of different motors 15, 20 and 30 are illustrated in FIG. 1, in practice they may all comprise different gears or pulleys connected to and driven by a single electric motor.

In accordance with the present invention, the rolls 27, 29 are mounted so that the axes of rotation 31, 32 (which are typically horizontal) thereof are fixed with respect to each other, and so that there is a gap 33 (see FIG. 2) therebetween. According to the invention, for single part forms with a weight up to 32 lbs., the gap 33 is between 0.005 and 0.008 inches, optimally about 0.007 inches. That is the peripheral surfaces of the substantially smooth surfaced rolls 27, 29 never engage each other.

The high speed rolls 24 preferably are of a type that are spring biased together, as indicated schematically by the spring bias mechanism 35 (FIGS. 1 and 3), and are driven by the separate motor 36, also under the control of the controller 16.

The breaker blade assembly 25 is preferably of a fixed position design. Blade 38 thereof is fixed during operation, but can be adjusted when not in operation to accommodate varying form depths.

The exact way that the basic operation of the components is controlled is conventional, such as in the Moore 3500 or 3400 machines, and/or in U.S. Pat. No. 5,104,022.

Once the forms have been burst, they pass from the high speed rolls 24 to a downstream mechanism 41 for otherwise handling the forms, such as a stacker, folder, gluer, or the like.

FIG. 3 schematically shows bursting action for a particular form. A single part continuous business form is shown schematically by reference numeral 43, and is being moved in the direction 12 to the slow speed rolls 23, and the spring biased high speed rolls 24. Once a cross perforation line 44 in the continuous form 43 has reached a predetermined position, and a single one of the continuous forms 43—shown generally by reference numeral 45 in FIG. 3—enters the nip between the high speed rolls 24, the form 45 is snapped up against the breaker blade 38, where the cross portion 44 engages the blade points, and the continuous form 43 is thus burst at perforation line 44 as schematically illustrated in FIG. 3. There is no need to move blade 38 into contact with the forms 43, as is conventional.

Because of the stationary mounting of the axes 31, 32 of the slow speed rollers 27, 29, with the particular gap 33, and/or the over speed rolls and transport belts 19, 18, respectively, a bubble does not form in the forms 43, and the need for axial grooves in the upper roll 27 is eliminated, as is the need for a servo or stepper motor for cycling the slow speed rolls 23 apart and together, or the need to move the breaker blade 38. Utilizing the burster 10 it is possible to effectively burst paper continuous business forms having a weight of about 32 lbs. or less (e.g. about 16–32 lbs.) at a speed of up to about 600 fpm.

While the invention has been described above with slow speed rolls 23 providing means for guiding forms to the high speed rolls 24, other guiding means could be utilized. For example, FIG. 4 schematically illustrates the guiding means 50 (which may be substituted for rolls 23 where high speed and heavy duty operation is not essential), which comprises a pair of fixed sheet metal guide plates 51, 52, having a tapered inlet 53 and tapered outlet 54. The guide plates 51, 52 are known per se, but according to the invention the gap 33 is provided therebetween, the gap 33 as earlier described with respect to the rolls 23 (i.e. between about 0.005–0.008 inches). While gap 33 is fixed during operation, prior to operation it may be adjusted (e.g. by moving one of the plates 51, 52 using any suitable conventional means) to accommodate forms of different depth.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A burster for business forms comprising:

a transport mechanism; a pair of driven high speed rolls; a plurality of guide elements for guiding forms to said high speed rolls; and a breaker blade between said guide elements and high speed rolls;

said guide elements mounted so that said guide elements have a fixed gap, greater than zero, therebetween during processing of business forms having a particular weight, said fixed gap sufficient to prevent formation of a form bubble in business forms being burst by said burster;

said fixed gap being between 0.005 and 0.008 inches, and adjusted prior to operation of said burster;

said transport mechanism comprising a tractor pin feed drive located upstream of said guide elements, and a set of driven pull rolls located between said tractor pin feed drive and said guide elements.

2. A burster as recited in claim 1 wherein said transport mechanism further comprises a transport belt assembly.

3. A burster for business forms comprising:

a transport mechanism; a pair of driven high speed rolls; a plurality of guide elements for guiding forms to said high speed rolls; and a breaker blade between said guide means and high speed rolls;

said guide elements mounted so that said guide elements have a fixed gap, greater than zero, therebetween during processing of business forms having a particular weight, said fixed gap sufficient to prevent formation of a form bubble in business forms being burst by said burster;

said fixed gap being between 0.005 and 0.008 inches, and adjusted prior to operation of said burster;

said guide elements comprising a pair of driven slow speed rolls.

4. A burster as recited in claim 3 wherein said slow speed rolls are smooth surfaced.

5. A burster for business forms, comprising:

a transport mechanism; a pair of driven slow speed rolls; a pair of spring biased driven high speed rolls downstream of said slow speed rolls; and a breaker blade between said slow and high speed rolls; and said slow speed rolls mounted so that they are spaced apart a fixed distance of between about 0.005–0.008 inches.

6. A burster as recited in claim 5 wherein said fixed distance is about 0.007 inches.

7. A burster as recited in claim 5 wherein said transport mechanism comprises a tractor pin feed drive located upstream of said slow speed rolls, a set of driven pull rolls located between said tractor pin feed drive and said slow rolls, and a transport belt assembly.

8. A burster as recited in claim 5 wherein said slow speed rolls are substantially smooth surfaced, and wherein said fixed distance is adjustable prior to operation of said burster.

9. Apparatus as recited in claim 5 wherein said breaker blade is stationary, said forms being snapped into engagement therewith during operation.

10. A burster for business forms, comprising:

a transport mechanism; a pair of fixed guide plates; a pair of spring biased driven high speed rolls downstream of said guide plates; and a breaker blade between said high speed rolls and guide plates;

said guide plates mounted so that said plates are spaced apart a fixed distance of between about 0.005–0.008 inches;

said guide plates being sheet metal plates, and wherein said fixed distance between said guide plates is adjustable prior to operation of said burster.

11. A method of bursting continuous single part business forms having perforation lines formed periodically therein; and having a paper weight of about 32 lb. or less, utilizing a burster having gapped slow speed rolls upstream of high speed rolls, and a breaker blade between the slow and high speed rolls, comprising the steps of:

(a) feeding the forms with a paper weight of about 32 lbs. or less to the slow speed rolls at a speed not less than a first speed;

(b) driving the slow speed rolls at substantially the first speed;

(c) passing the forms through a fixed gap between the slow speed rolls of between 0.005–0.008 inches that is of sufficient spacing to prevent bubble formation in the forms;

(d) driving the high speed rolls at a second speed, significantly greater than the first speed; and (e) when a perforation moves past the slow speed rolls, effecting bursting at a perforation line;

wherein steps (a)–(e) are practiced at a form transport speed of about 600 fpm and with business forms having a weight of about 16–32 lbs.

12. A method of bursting continuous single part business forms having perforation lines formed periodically therein; and having a paper weight of about 32 lb. or less, utilizing a burster having gapped slow speed rolls upstream of high speed rolls, and a breaker blade between the slow and high speed rolls, comprising the steps of:

(a) feeding the forms with a paper weight of about 32 lbs. or less to the slow speed rolls at a speed not less than a first speed;

(b) driving the slow speed rolls at substantially the first speed;

(c) passing the forms through a fixed gap between the slow speed rolls of between 0.005–0.008 inches that is of sufficient spacing to prevent bubble formation in the forms and adjusting the gap prior to the practice of step (a);

(d) driving the high speed rolls at a second speed, significantly greater than the first speed; and (e) when a perforation moves past the slow speed rolls, effecting bursting at a perforation line.

13. A method of bursting continuous single part business forms having perforation lines formed periodically therein; and having a paper weight of about 32 lb. or less, utilizing a burster having gapped slow speed rolls upstream of high speed rolls, and a breaker blade between the slow and high speed rolls, comprising the steps of:

(a) feeding the forms with a paper weight of about 32 lbs. or less to the slow speed rolls at a speed not less than a first speed;

(b) driving the slow speed rolls at substantially the first speed;

(c) passing the forms through a gap between the slow speed rolls that is of sufficient spacing to prevent bubble formation in the forms;

(d) driving the high speed rolls at a second speed, significantly greater than the first speed;

(e) when a perforation moves past the slow speed rolls, effecting bursting at a perforation line;

moving the forms toward the high speed rolls on transport belts; and driving the belts at a third speed slightly higher than the first speed, but not as great as the second speed, so that step (a) is practiced at the third speed.

14. A method of bursting continuous single part business forms having perforation lines formed periodically therein, and having a paper weight of about 32 lb. or less, utilizing a burster having gapped guide plates upstream of high speed rolls, and a breaker blade between the guide plates and high speed rolls, comprising the steps of:

(a) feeding the forms having a paper weight of about 32 lb. or less to the guide plates at a first speed;

(b) passing the forms through a fixed gap between the guide plates of between 0.005–0.008 inches that is of sufficient spacing to prevent bubble formation in the forms and adjusting the gap prior to the practice of step (a);

(c) driving the high speed rolls at a second speed, significantly greater than the first speed; and (d) when a perforation moves past the guide plates into operative association with the breaker blade, effecting bursting at a perforation line.

* * * * *

UNITED STATES PATENT AND TRADEMARK OFFICE

CERTIFICATE OF CORRECTION

PATENT NO. : 5,735,443

DATED : April 7, 1998

INVENTOR(S) : Robert S. Ring

It is certified that error appears in the above-identified patent and that said Letters Patent is hereby corrected as shown below:

On the title page item [56],

--[56] Attorney, Agent, or Firm- Nixon & Vanderhye P.C.

Signed and Sealed this

Fifteenth Day of September, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,735,443

DATED : April 7, 1998

INVENTOR(S) : Robert S. Ring

It is certified that error appears in the above-identified patent and that said Letters Patent is hereby corrected as shown below:

On the title page, item:

--[73] Assignee: Moore Business Forms, Inc., Grand Island, N.Y. --

--[56] Attorney, Agent, or Firm- Nixon & Vanderhye P.C.

Signed and Sealed this

Fifteenth Day of June, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,735,443
APPLICATION NO. : 08/117669
DATED : April 7, 1998
INVENTOR(S) : Robert S. Ring It is certified that error appears in the above-identified patent and that said Letters Patent is hereby corrected as shown below:

On the title page, insert:

--Item [73], Assignee: Moore Business Forms, Inc., Grand Island, N.Y.--.
--Item [74], Attorney, Agent, or Firm- Nixon & Vanderhye P.C.

This certificate supersedes Certificate of Correction issued June 15, 1999.

Signed and Sealed this

Nineteenth Day of December, 2006

JON W. DUDAS
*Director of the United States Patent and Trademark Office*